US009507294B2

(12) United States Patent
Funayama et al.

(10) Patent No.: US 9,507,294 B2
(45) Date of Patent: Nov. 29, 2016

(54) IMAGE-FORMING APPARATUS CAPABLE OF FORMING MULTI-COLOR FULL-BLEED IMAGE

(71) Applicant: FUJI XEROX CO., LTD., Tokyo (JP)

(72) Inventors: Yasuhiro Funayama, Kanagawa (JP); Yoshinori Takahashi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/857,280

(22) Filed: Sep. 17, 2015

(65) Prior Publication Data

US 2016/0274499 A1 Sep. 22, 2016

(30) Foreign Application Priority Data

Mar. 18, 2015 (JP) ..... 2015-054633

(51) Int. Cl.
*G03G 15/01* (2006.01)
*G03G 15/16* (2006.01)

(52) U.S. Cl.
CPC ..... *G03G 15/1605* (2013.01); *G03G 15/0131* (2013.01); *G03G 15/0189* (2013.01)

(58) Field of Classification Search
CPC ..... G03G 15/01; G03G 15/0131; G03G 15/0189; G03G 15/1605; G03G 15/5095
USPC ..... 399/40, 45, 298, 299, 302; 347/115; 358/1.18
See application file for complete search history.

(56) References Cited

U.S. PATENT DOCUMENTS 8,814,305 B2 * 8/2014 Mizes ..... B41J 2/2146 347/14
8,849,139 B2 * 9/2014 Makino ..... G03G 15/167 399/66
9,120,342 B2 * 9/2015 De Grijs ..... B41J 11/0065
2007/0002095 A1 * 1/2007 Ozawa ..... G03G 15/5095 347/37
2007/0019220 A1 * 1/2007 Miyazaki ..... G03G 15/5095 358/1.12
2007/0025780 A1 * 2/2007 Kurosu ..... G03G 15/16 399/313
2009/0052966 A1 * 2/2009 Yamashita ..... G03G 15/6573 399/407
2010/0158546 A1 * 6/2010 No ..... G03G 15/2064 399/16

FOREIGN PATENT DOCUMENTS

JP 2006-220991 A 8/2006
JP 2011164208 A * 8/2011
JP 2014-21379 A 2/2014

* cited by examiner

*Primary Examiner* — Robert Beatty
(74) *Attorney, Agent, or Firm* — Sughrue Mion, PLLC

(57) ABSTRACT

An image-forming apparatus includes multiple image-forming units capable of forming a full-bleed image with no margin around a recording medium in an image-forming region larger than an image-forming surface region of the recording medium using three or more toners having a volume average particle size of about 2 to about 5 μm, an intermediate transfer member, a transfer device, a fixing device, and an image-forming process unit that, at least if an image to be formed in a peripheral region of the recording medium during the formation of the full-bleed image has a toner layer thickness larger than or equal to a predetermined threshold, converts the image to be formed in the peripheral region of the recording medium into an image having a toner layer thickness smaller than or equal to the threshold while maintaining the image density ratio of the individual toners.

20 Claims, 15 Drawing Sheets

IMAGE-FORMING APPARATUS CAPABLE OF FORMING MULTI-COLOR FULL-BLEED IMAGE

CROSS-REFERENCE TO RELATED APPLICATIONS

This application is based on and claims priority under 35 USC 119 from Japanese Patent Application No. 2015-054633 filed Mar. 18, 2015.

BACKGROUND

Technical Field

The present invention relates to image-forming apparatuses.

SUMMARY

According to an aspect of the invention, there is provided an image-forming apparatus including multiple image-forming units capable of forming a full-bleed image with no margin around a recording medium in an image-forming region larger than an image-forming surface region of the recording medium using toners of three or more color components having a volume average particle size of about 2 to about 5 μm; an intermediate transfer member to which images are transferred from the image-forming units and on which the images are carried before the images are transferred to the recording medium; a transfer device that simultaneously transfers the images from the intermediate transfer member to the recording medium; a fixing device that fixes the images transferred by the transfer device to the recording medium; and an image-forming process unit that, at least if an image to be formed in a peripheral region of the recording medium during the formation of the full-bleed image has a toner layer thickness larger than or equal to a predetermined threshold, converts the image to be formed in the peripheral region of the recording medium into an image having a toner layer thickness smaller than or equal to the threshold while maintaining the image density ratio of the individual toners.

BRIEF DESCRIPTION OF THE DRAWINGS

Exemplary embodiments of the present invention will be described in detail based on the following figures, wherein.

DETAILED DESCRIPTION

Overview of Exemplary Embodiments

Figure 1A:
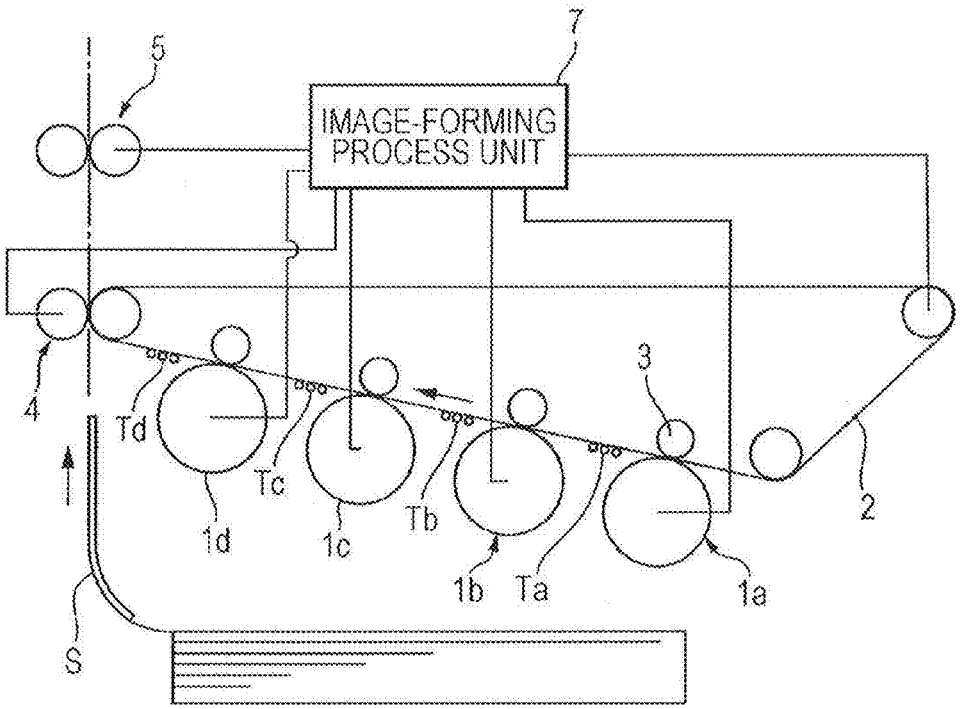
FIG. 1A is a schematic view of an intermediate-transfer image-forming apparatus according to an exemplary embodiment of the present invention.

FIG. 1A shows an image-forming apparatus according to an exemplary embodiment of the present invention.

The image-forming apparatus shown in FIG. 1A includes multiple image-forming units 1 (in this exemplary embodiment, 1*a* to 1*d*) that form a full-bleed image with no margin around a recording medium S in an image-forming region Z (see FIG. 1B) larger than the image-forming surface region of the recording medium S using toners T (in this exemplary embodiment, Ta to Td) of multiple (in this exemplary embodiment, four) color components; an intermediate transfer member 2 to which images are transferred from the image-forming units 1 and on which the images are carried before the images are transferred to the recording medium S; a transfer device 4 that simultaneously transfers the images from the intermediate transfer member 2 to the recording medium S; and a fixing device 5 that fixes the images transferred by the transfer device 4 to the recording medium S. The toners T have a volume average particle size of 2 to 5 μm or about 2 to about 5 μm. The image-forming apparatus further includes an image-forming process unit 7. As shown in FIGS. 1C and 2A, at least if an image $I_R$ to be formed in a peripheral region R of the recording medium S during the formation of the full-bleed image has a toner layer thickness h larger than or equal to a predetermined threshold m, the image-forming process unit 7 converts the image $I_R$ to be formed in the peripheral region R of the recording medium S into an image having a toner layer thickness h smaller than or equal to the threshold m while maintaining the image density ratio of the individual toners T.

In FIG. 1A, the intermediate transfer member 2 is entrained and moved around multiple tensioning members. The image-forming apparatus further includes transfer units 3 disposed opposite the image-forming units 1 (1*a* to 1*d*). The transfer units 3 transfer the images of the toners T from the image-forming units 1 (1*a* to 1*d*) to the intermediate transfer member 2. During the formation of the full-bleed image, an image $I_A$ (see FIG. 1C) located inside the peripheral region R of the recording medium S is formed based on image data.

In this exemplary embodiment, the image-forming units 1 are configured to form images of the toners T. Typically, the image-forming units 1 include image carriers such as photoreceptors and dielectric members and electrophotographically form images of the toners T (in this exemplary embodiment, Ta to Td) on the image carriers.

The image-forming apparatus according to this exemplary embodiment is an intermediate-transfer image-forming apparatus.

The intermediate transfer member 2 may be either belt-shaped or drum-shaped. Although the transfer device 4 is typically an electrostatic transfer device, other types of transfer devices may also be used, including pressure transfer devices and thermal transfer devices. The fixing device 5 may be any fixing device that can fix the toners T to the recording medium S. Examples of such fixing devices include various contact fixing devices that apply heat, pressure, or both to the recording medium S as it passes between fixing members and non-contact fixing devices including heating light sources such as lasers.

Figure 1C:
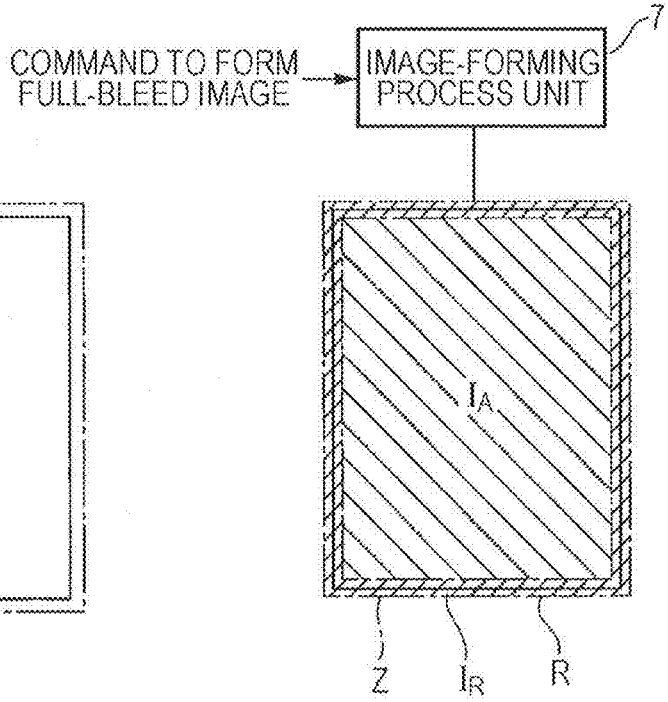
FIG. 1C is a schematic view illustrating the operation of an image-forming process unit during the formation of a full-bleed image.
Figure 2A:
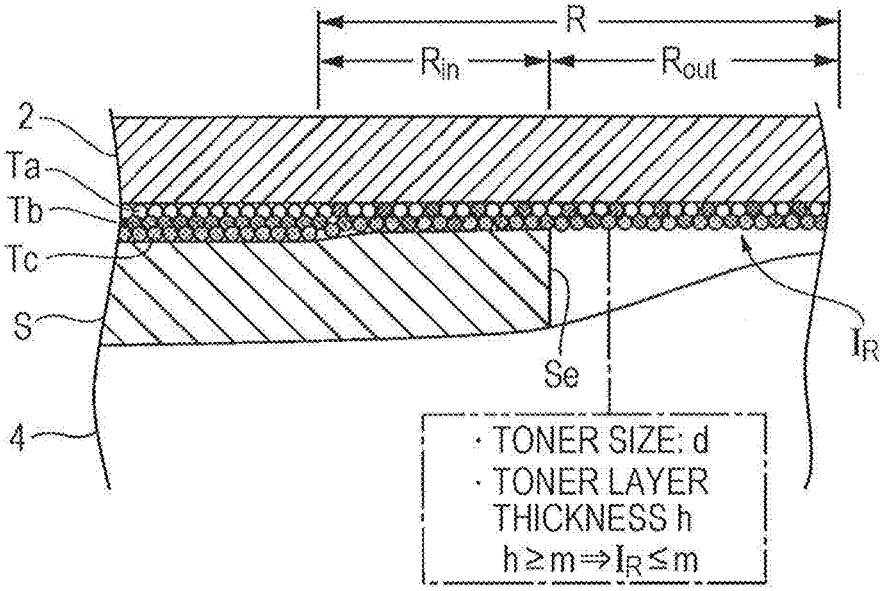
FIG. 2A is a schematic view illustrating the operation of the image-forming process unit during the formation of a full-bleed image.
Figure 2B:
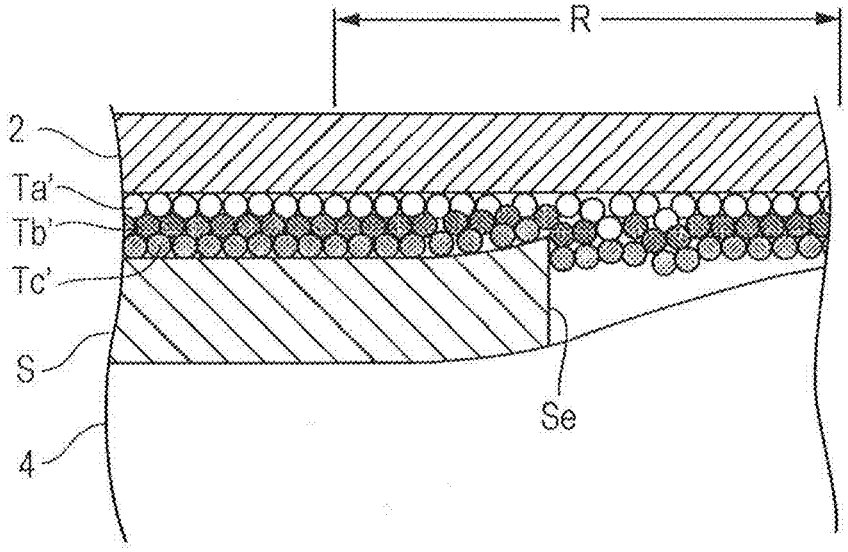
FIG. 2B is a schematic view illustrating the operation of an image-forming apparatus according to a first comparative example during the formation of a full-bleed image.

For an intermediate-transfer image-forming apparatus according to a first comparative example, as shown in FIG. 2B, a full-bleed image composed of toner layers is transferred to the peripheral region R (see FIG. 1C) of the recording medium S by the second transfer unit of the transfer device 4. When layers of toners T' (e.g., Ta', Tb', and Tc') in the peripheral region R of the recording medium S are pressed by the second transfer unit, much toner T' is squeezed out of the edge Se of the recording medium S in a region having a large toner layer thickness, and much toner T' is deposited at the edge Se of the recording medium S. This is because much toner T' is present in the peripheral region R of the recording medium S and the toners T' have high flowability. When the recording medium S having much toner T' deposited at the edge Se thereof passes through the fixing position of the fixing device 5, no pressure is applied to the toner T' deposited at the edge Se of the recording medium S at the fixing position, and unfixed toner T' remains. The unfixed toner T' would cause toner soiling after printing.

Figure 3A:
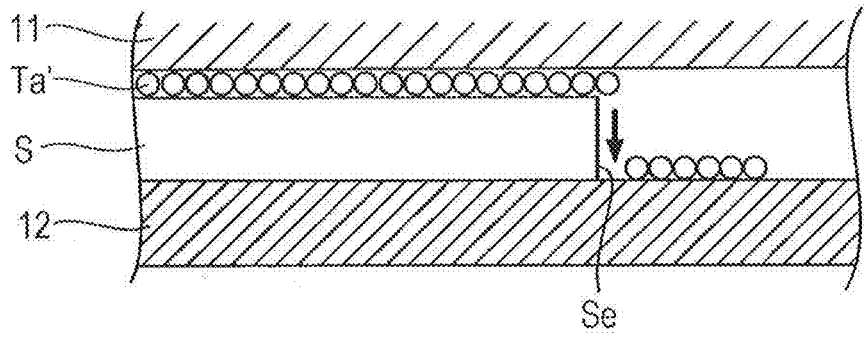
FIGS. 3A and 3B are schematic views illustrating the operation of a direct-transfer image-forming apparatus according to a second comparative example during the formation of a full-bleed image.
Figure 3B:
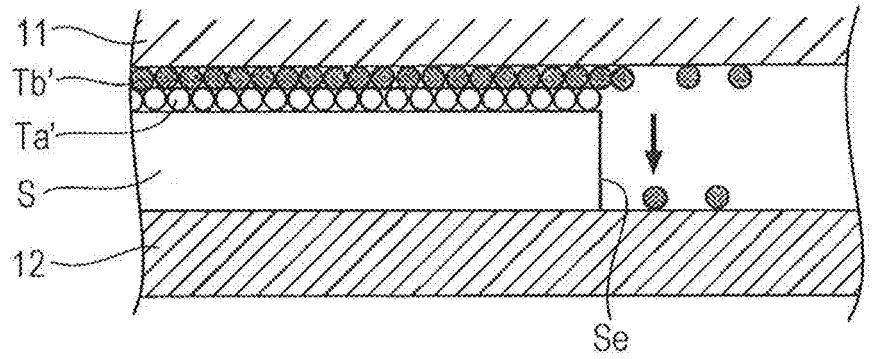

For a direct-transfer image-forming apparatus according to a second comparative example, as shown in FIGS. 3A and 3B, images of toners T' (e.g., Ta' and Tb') are sequentially transferred from the image carriers 11, such as photoreceptors, of the image-forming units 1 to a recording medium S on a recording medium transport member 12. There is a gap equivalent to the thickness of the recording medium S in an outer peripheral region $R_{out}$ outside the recording medium S. This gap reduces the likelihood of the images being transferred from the image carriers 11 to the recording medium transport member 12 and thus reduces the likelihood of the edge Se of the recording medium S being soiled. The above technical problem is therefore less likely to occur.

Figure 1B:
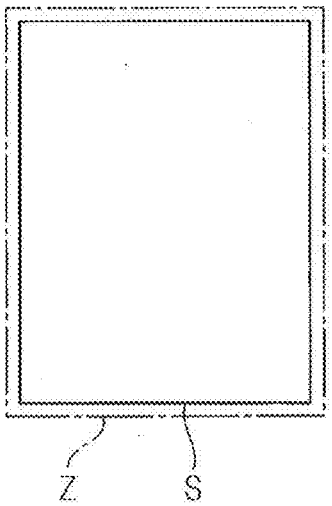
FIG. 1B is a schematic view illustrating a full-bleed image mode.

During the formation of a full-bleed image, as shown in FIG. 1B, images of the toners T are formed in the image-forming region Z larger than the recording medium S. Otherwise, a margin might remain around the recording medium S due to any error in the transport position of the recording medium S after the formation of the full-bleed image.

The toners T are small-sized toners, i.e., toners having a volume average particle size of 2 to 5 μm or about 2 to about 5 μm. The small-sized toners T may have a higher pigment content than large-sized toners T' to maintain the hues of the images.

As shown in FIG. 2A, if the image to be formed in the peripheral region R of the recording medium S has a toner layer thickness h larger than or equal to a predetermined threshold m, the image-forming process unit 7 may adjust the image to be formed in the peripheral region R of the recording medium S to a thickness smaller than or equal to the threshold m to reduce the amount of toner T in the peripheral region R of the recording medium S.

As used herein, the term "peripheral region R of the recording medium S" refers to a region extending along the edge of the recording medium S. The peripheral region R of the recording medium S may include at least one of an inner peripheral region $R_{in}$ within the recording medium S and an outer peripheral region $R_{out}$ outside the recording medium S. The image density ratio of the individual toners T is maintained to prevent any alteration in image hue and thereby to ensure high image reproducibility.

In this exemplary embodiment, a full-bleed image is formed using small-sized toners such that less toner T is deposited in a region having a large toner layer thickness. This may reduce the amount of toner T deposited at the edge Se of the recording medium S and may thus reduce the height of the cross-section of the toner T deposited at the edge Se of the recording medium S. Although less pressure is applied to the edge Se of the recording medium S at the fixing position, less toner soiling may occur. In addition, for example, a small amount of toner T may be fixed by heat from a thermal fixing device.

Typical exemplary embodiments and other exemplary embodiments will now be described.

In a typical exemplary embodiment, the toners T may have low-temperature fixing properties. Specifically, the toners T may have a tan δ of 1.10 to 1.40 or about 1.10 to about 1.40 at 80° C. to 140° C. as determined by viscoelasticity measurement at a frequency of 1 Hz over a temperature range of 30° C. to 180° C. Viscoelasticity measurement is employed to demonstrate that the toners T have low-temperature fixing properties. The details will be described in the first exemplary embodiment below.

In a typical exemplary embodiment, the image-forming process unit 7 defines the peripheral region R of the recording medium S as including an inner peripheral region $R_{in}$ having a width of 1 to 3 mm or about 1 to about 3 mm within the recording medium S and converts the image to be formed in the peripheral region R of the recording medium S during the formation of the full-bleed image. In this exemplary embodiment, in which the peripheral region R of the recording medium S includes the inner peripheral region $R_{in}$ within the recording medium S, the image-forming process unit 7 reduces the amount of toner T in the image to be formed in the inner peripheral region $R_{in}$ of the recording medium S. This may reduce the amount of toner T squeezed out of the inner peripheral region $R_{in}$.

In a typical exemplary embodiment, at least if the image to be formed in the peripheral region R of the recording medium S during the formation of the full-bleed image has a toner layer thickness h larger than or equal to two layers (threshold m), the image-forming process unit 7 converts the image to be formed in the peripheral region R of the recording medium S into an image having a toner layer thickness h of two layers while maintaining the image density ratio of the individual toners T. In this exemplary embodiment, in which the image-forming process unit 7 converts an image having a toner layer thickness h larger than or equal to two layers into an image having a toner layer thickness h of two layers, the image-forming process unit 7 mainly reduces the amount of toner T in a region having a large toner layer thickness h. This may reduce the amount of toner T deposited at the edge Se of the recording medium S.

In another exemplary embodiment, if the image to be formed in the peripheral region R of the recording medium S has a toner layer thickness h smaller than two layers but not smaller than one layer (threshold m), the image-forming process unit 7 converts the image to be formed in the peripheral region R of the recording medium S into an image having a toner layer thickness h of one layer while maintaining the image density ratio of the individual toners T. In this exemplary embodiment, the image-forming process unit 7 also reduces the amount of toner T in a region having an intermediate thickness in the image to be formed in the peripheral region R of the recording medium S.

In these exemplary embodiments, the toner layer thickness h is converted to a predetermined number of toner layers, such as one or two layers. This is intended to apply uniform pressure to the toner layers and thereby to reduce the amount of toner T squeezed out. If the toner layer thickness h is converted to different numbers of toner layers, the toner layers would have protrusions and depressions, and the amount of toner T squeezed out would increase locally due to variations in pressure distribution.

In another exemplary embodiment, if the image to be formed in the peripheral region R of the recording medium S has a toner layer thickness h smaller than one layer, the image-forming process unit 7 does not convert the image to be formed in the peripheral region R of the recording medium S. In this exemplary embodiment, the image-forming process unit 7 does not reduce the amount of toner T since the amount of toner T squeezed out is minimized in a region having a small toner layer thickness in the image to be formed in the peripheral region R of the recording medium S.

First Exemplary Embodiment

A specific exemplary embodiment of the present invention will now be described with reference to the attached drawings.

Overall Configuration of Image-Forming Apparatus

Figure 4:
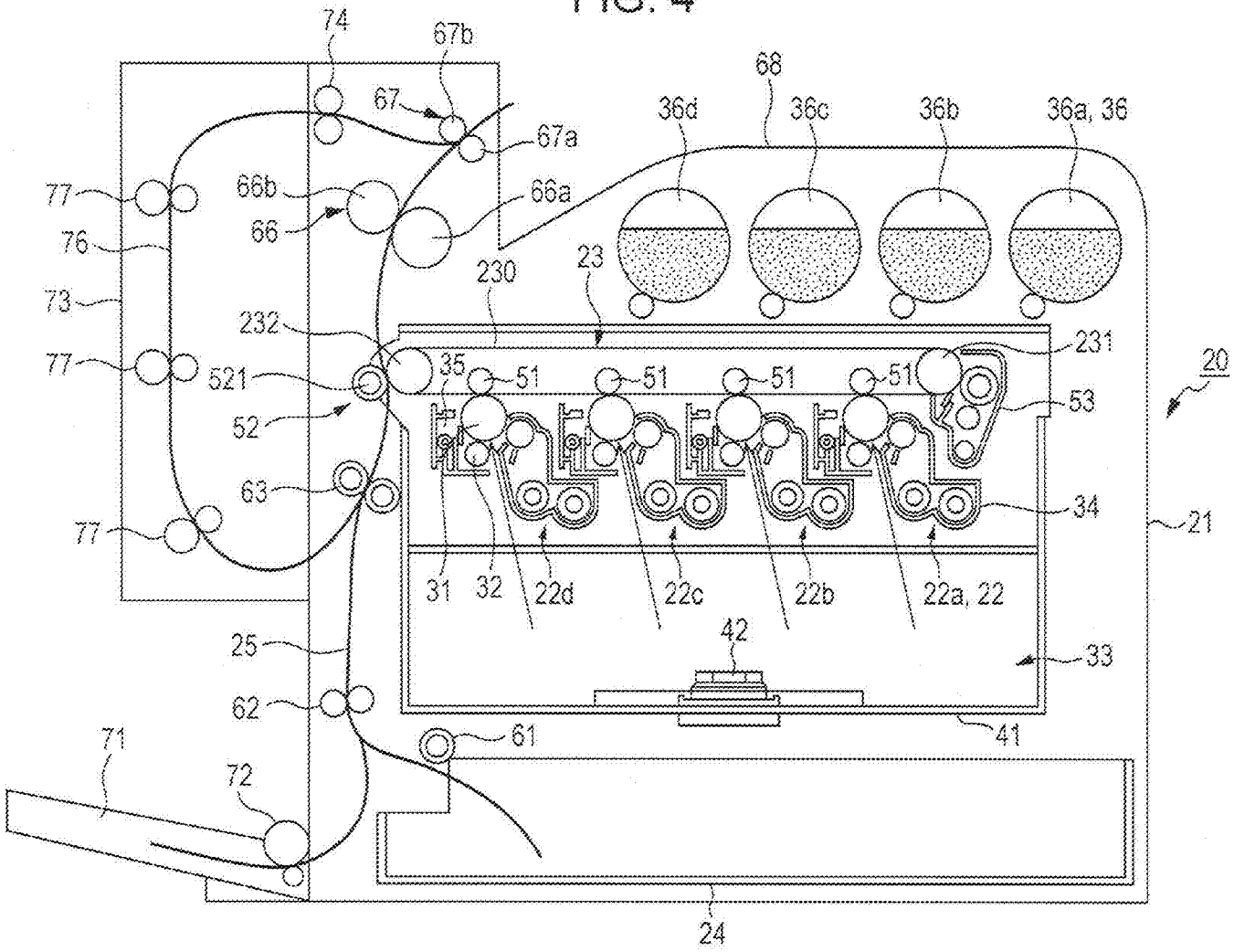
FIG. 4 is a schematic view showing the overall structure of an image-forming apparatus according to a first exemplary embodiment.

FIG. 4 is a schematic view of an image-forming apparatus according to a first exemplary embodiment of the present invention.

In FIG. 4, an image-forming includes four image-forming units 22 (specifically, 22*a* to 22*d*) of different colors (in this exemplary embodiment, black, yellow, magenta, and cyan) arranged laterally in an apparatus housing 21; a transfer module 23 disposed above the image-forming units 22 and including an intermediate transfer belt 230 configured to be moved in the direction in which the image-forming units 22 are arranged; a recording medium feeder 24 disposed in the lower part of the apparatus housing 21 and containing recording media such as sheets of paper; and a recording medium transport path 25 disposed substantially vertically.

In this exemplary embodiment, the image-forming units 22 (22*a* to 22*d*) form, for example, in order from upstream in the moving direction of the intermediate transfer belt 230, black, yellow, magenta, and cyan toner images (other orders are also possible). Each image-forming unit 22 includes a photoreceptor 31, a charging device (in this exemplary embodiment, a charging roller) 32 that charges the photoreceptor 31 in advance, an exposure device 33 (in this exemplary embodiment, a single exposure device shared by the image-forming units 22) that forms an electrostatic latent image on the photoreceptor 31 charged by the charging device 32, a developing device 34 that develops the electrostatic latent image formed on the photoreceptor 31 with a toner of the corresponding color (in this exemplary embodiment, for example, a negatively charged toner), and a cleaning device 35 that removes residual toner from the photoreceptor 31.

In this exemplary embodiment, as shown in FIG. 4, the image-forming units 22, the photoreceptors 31, the charging devices 32, the developing devices 34, and the cleaning devices 35 are assembled into process cartridges. The process cartridges are detachably attached to assembly slots (not shown) of the apparatus housing 21.

The exposure device 33 includes, for example, four semiconductor lasers (not shown), a polygon mirror 42, imaging lenses (not shown), and mirrors (not shown) corresponding to the photoreceptors 31 that are accommodated in an exposure housing 41. Laser beams emitted from the individual semiconductor lasers are deflected and scanned by the polygon mirror 42 and are directed to the exposure positions of the corresponding photoreceptors 31 via the imaging lenses and the mirrors.

Each developing device 34 includes a developer container containing, for example, a two-component developer containing a toner and a carrier or a one-component developer containing a toner without a carrier. The developer is carried and transported by a developing roller disposed in the developer container to develop the electrostatic latent image formed on the photoreceptor 31.

Toner cartridges 36 (36*a* to 36*d*) supply toners of the corresponding colors to the developing devices 34.

In this exemplary embodiment, the transfer module 23 includes, for example, a pair of tension rollers (one of which is a drive roller) 231 and 232 around which the intermediate transfer belt 230 is entrained and first transfer devices (in this exemplary embodiment, first transfer rollers) 51 disposed opposite the photoreceptors 31 of the image-forming units 22 on the back surface of the intermediate transfer belt 230. A voltage of opposite polarity to the charge on the toners is applied to the first transfer devices 51 to electrostatically transfer the toner images from the photoreceptors 31 to the intermediate transfer belt 230.

A second transfer device 52 is disposed opposite the tension roller 232 downstream of the most downstream image-forming unit 22*d* along the intermediate transfer belt 230 to transfer (simultaneously transfer) the first transfer images from the intermediate transfer belt 230 to a recording medium.

Figure 5:
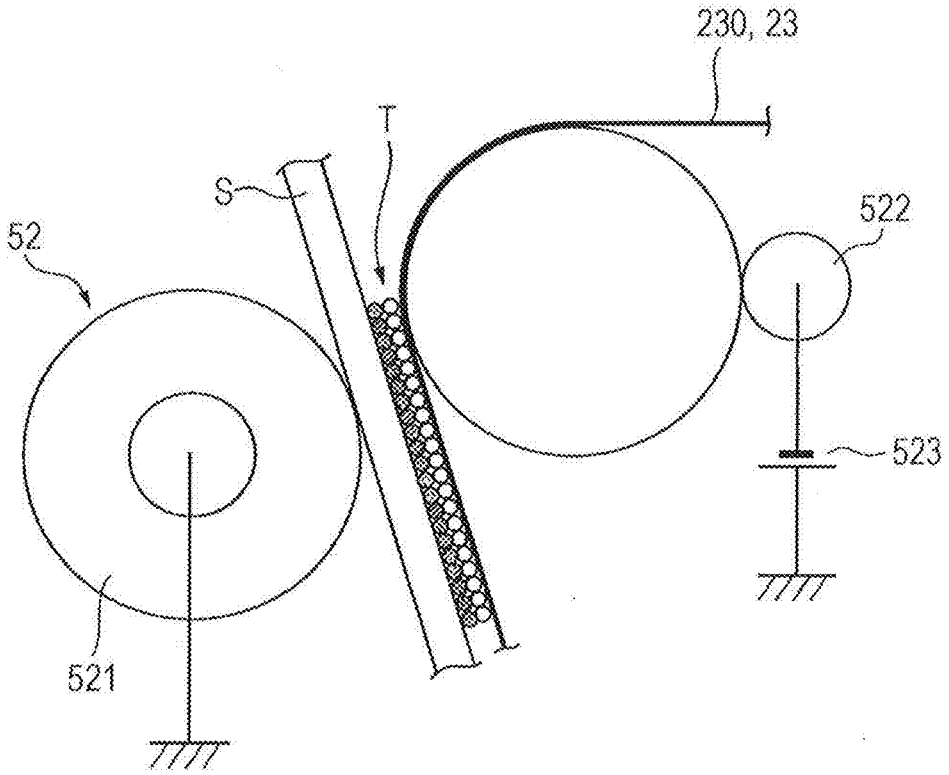
FIG. 5 is a partial schematic view of a simultaneous transfer device used in the first exemplary embodiment.

In this exemplary embodiment, as shown in FIGS. 4 and 5, the second transfer device 52 includes a second transfer roller 521 pressed against the toner-image carrying side of the intermediate transfer belt 230 and a backup roller (in this exemplary embodiment, the tension roller 232 serves as a backup roller) disposed on the backside of the intermediate transfer belt 230 and serving as a counter electrode for the second transfer roller 521.

For example, the second transfer roller 521 is grounded, and a bias 523 of the same polarity as the charge on the toner is applied to the backup roller (tension roller 232) via a power supply roller 522.

A belt-cleaning device 53 is disposed upstream of the most upstream image-forming unit 22*a* along the intermediate transfer belt 230 to remove residual toner from the intermediate transfer belt 230.

The recording medium feeder 24 includes a feed roller 61 that feeds a recording medium. Transport rollers 62 are disposed immediately downstream of the feed roller 61 to transport the recording medium. Registration rollers 63 are disposed on the recording medium transport path 25 immediately upstream of the second transfer position to feed the recording medium at a predetermined timing to the second transfer position.

A fixing device 66 is disposed downstream of the second transfer position on the recording medium transport path 25. As shown in FIG. 4, the fixing device 66 includes a heat fixing roller 66*a* incorporating a heater (not shown) and a pressure fixing roller 66*b* pressed against the heat fixing roller 66*a* so as to be rotatable as the heat fixing roller 66*a* rotates.

A recording medium output device 67 is disposed downstream of the fixing device 66. The recording medium output device 67 includes a pair of output rollers 67*a* and 67*b* that output the recording medium from the apparatus housing 21. The recording medium is nipped between the output rollers 67*a* and 67*b* and is transported into a recording medium output bin 68 provided on the top of the apparatus housing 21.

In this exemplary embodiment, a multi-sheet inserter (MSI) 71 is disposed on one side of the apparatus housing 21. The multi-sheet inserter 71 includes a feed roller 72 that feeds a recording medium to the recording medium transport path 25.

A duplex recording module 73 is also provided on the apparatus housing 21. The duplex recording module 73 reverses the recording medium output device 67 upon selection of a duplex mode in which images are recorded on both sides of a recording medium. A recording medium on one side of which an image is already recorded is transported into the duplex recording module 73 by guide rollers 74 disposed in front of an entrance thereof and is transported back to the registration rollers 63 along a recording medium return transport path 76 in the duplex recording module 73 by an appropriate number of transport rollers 77.

The toners used in this exemplary embodiment will now be described.

Toners

The toners used in this exemplary embodiment are small-sized toners having a volume average particle size of 2 to 5 μm or about 2 to about 5 μm. The toners are composed of toner substrate particles containing a colorant, a release agent, and a binder resin and inorganic particles deposited on the surface of the toner substrate particles.

Volume Average Particle Size

The volume average particle size is measured using a Multisizer II (Beckman Coulter, Inc.), for example, at an aperture size of 50 μm. The measurement is performed after a toner is dispersed in an aqueous electrolyte solution (e.g., ISOTON) and is sonicated for 30 seconds or more.

A toner having a volume average particle size of less than 2 μm tends to have low flowability and chargeability and thus tends to cause background fogging and fall off a developing device. A toner having a volume average particle size of more than 5 μm has a correspondingly low resolution. The use of such toners also results in a large toner layer thickness. For example, during the formation of a full-bleed image with no margin around a recording medium, much toner is squeezed out and deposited at the edge of a recording medium.

Binder Resin

In this exemplary embodiment, the binder resin may contain a polyester resin. For example, the binder resin may contain a crystalline polyester resin and an amorphous polyester resin.

Crystalline Polyester Resin

The crystalline polyester resin may be prepared from linear aliphatic polymerizable monomers, rather than aromatic polymerizable monomers, to facilitate crystallization. Each polymerizable-monomer-derived component may be present in the polymer in an amount of 30 mol % or more to maintain crystallinity. The crystalline polyester resin is prepared from two or more polymerizable monomers, each of which may be present in an amount of 30 mol % or more.

The crystalline polyester resin preferably has a melting point of 50° C. to 100° C., more preferably 55° C. to 90° C., even more preferably 60° C. to 85° C. If the melting point falls below 50° C., the toner may have low storage stability (e.g., cause blocking during storage), and fixed images may also have low storage stability (e.g., cause problems such as document offset, in which fixed images stick to the background, to the back surfaces of sheets, or to each other, and vinyl chloride offset, in which images are transferred to vinyl chloride sheets). If the melting point exceeds 100° C., the toner may have insufficient low-temperature fixing properties.

The melting point of the crystalline polyester resin may be determined as the temperature of an endothermic peak observed by differential scanning calorimetry (DSC).

In this exemplary embodiment, the term "crystalline polyester resin" refers to both a polymer containing 100% polyester and a polymer of polyester with other components (copolymer). In the latter case, the components other than polyester are present in the polymer (copolymer) in an amount of 50% by mass or less.

For example, the crystalline polyester resin is synthesized from a polycarboxylic acid and a polyhydric alcohol. In this exemplary embodiment, the crystalline polyester resin may be obtained commercially or synthesized.

Examples of polycarboxylic acids include, but not limited to, aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; aromatic dicarboxylic acids, including dibasic acids, such as phthalic acid, isophthalic acid, terephthalic acid, naphthalene-2,6-dicarboxylic acid, malonic acid, and mesaconic acid; and anhydrides and lower alkyl esters thereof.

Preferable polyhydric alcohols include aliphatic diols, more preferably linear aliphatic diols containing 7 to 20 main chain carbon atoms. Branched aliphatic diols may decrease the crystallinity and thus lower the melting temperature. Aliphatic diols containing less than 7 main chain carbon atoms, when reacted with aromatic dicarboxylic acids, may form a polycondensate having high melting temperature, which is not suitable for low-temperature fixing. Aliphatic diols containing more than 20 main chain carbon atoms are not easily available commercially. More preferable are aliphatic diols having 14 or less main chain carbon atoms.

Amorphous Polyester Resin

Examples of amorphous polyester resins for use in this exemplary embodiment include polycondensates of polycarboxylic acids with polyhydric alcohols.

Examples of polycarboxylic acids and polyhydric alcohols include those listed for the crystalline polyester resin.

The amorphous polyester resin preferably has a glass transition temperature (Tg) of 50° C. to 80° C. If Tg falls below 50° C., the toner may have low storage stability, and fixed images may also have low storage stability. If Tg exceeds 80° C., the toner may be less suitable for low-temperature fixing than conventional toners. More preferably, the amorphous polyester resin has a Tg of 50° C. to 65° C.

To achieve good image fixing properties, the binder resin containing the crystalline polyester resin and the amorphous polyester resin preferably has a softening temperature (½ lowering temperature measured with a flow tester) of 90° C. to 140° C., more preferably 100° C. to 135° C., even more preferably 100° C. to 120° C.

Colorant

The toners may optionally contain a colorant. Although the colorant may be either a dye or a pigment, pigments may be used for reasons of light resistance and water resistance.

Examples of pigments include yellow pigments (e.g. chrome yellow, zinc yellow, and the like), black pigments (e.g. carbon black, copper oxide, and the like), orange pigments (e.g. chrome orange, molybdenum orange, and the like), red pigments (e.g. iron oxide red, cadmium red, and the like), blue pigments (e.g. Prussian blue, cobalt blue, and the like), violet pigments (e.g. manganese violet, Fast Violet B, and the like), green pigments (e.g. chromium oxide, chrome green, and the like), white pigments (e.g. zinc oxide, titanium oxide, and the like), and extender pigments (e.g. barite powder, barium carbonate, and the like). Examples of dyes include various dyes such as basic dyes, acidic dyes, disperse dyes, and direct dyes, including nigrosine, methylene blue, rose bengal, quinoline yellow, and ultramarine blue. These colorants may be used alone or as a mixture or solid dispersion.

The colorant may be dispersed by known processes, for example, using devices such as rotary shear homogenizers, media dispersers such as ball mills, sand mills, and attritors, and high-pressure counter impact dispersers.

The colorant may be dispersed in an aqueous solvent containing a polar surfactant using a homogenizer.

The colorant may be selected depending on, for example, hue angle, saturation, lightness, weather resistance, and dispersibility in toner. The colorant may be present in an amount of 1 to 20 parts by mass based on 100 parts by mass of the resin.

Release Agent

The toners may optionally contain a release agent. Examples of release agents include low-molecular-weight polyolefins such as polyethylene, polypropylene, and polybutene; silicones having a softening point; fatty acid amides such as oleamide, erucamide, ricinoleamide, and stearamide; vegetable waxes such as carnauba wax, rice wax, candelilla wax, Japan wax, and jojoba oil; animal waxes such as bees wax; mineral and petroleum waxes such as montan wax, ozokerite, ceresin, paraffin wax, microcrystalline wax, and Fischer-Tropsch wax; ester waxes of higher fatty acids with higher alcohols, such as stearyl stearate and behenyl behenate; ester waxes of higher fatty acids with monohydric and polyhydric lower alcohols, such as butyl stearate, propyl oleate, glyceryl monostearate, glyceryl distearate, and pentaerythritol tetrabehenate; ester waxes of higher fatty acids with polyhydric alcohol multimers, such as diethylene glycol monostearate, dipropylene glycol distearate, diglyceryl distearate, and triglyceryl tetrastearate; sorbitan higher fatty acid ester waxes such as sorbitan monostearate; and cholesterol higher fatty acid ester waxes such as cholesteryl stearate. These release agents may be used alone or in combination.

Other Additives

In addition to the above components, the toners may optionally contain various components such as internal additives, charge control agents, inorganic powders (inorganic particles), and organic particles. Inorganic and organic particles serve as external additives for addition to the surface of toner particles.

Examples of internal additives include magnetic substances such as metals and alloys, including ferrite, magnetite, reduced iron, cobalt, manganese, and nickel, and compounds containing these metals. Such internal additives are used in an amount that does not result in decreased toner chargeability.

Any charge control agent may be used. For example, transparent or tinted charge control agents may be used for color toners. Examples of charge control agents include quaternary ammonium salts, nigrosines, complex dyes such as aluminum, iron, and chromium complex dyes, and triphenylmethane pigments.

Inorganic particles, which are generally added for various purposes such as improved flowability, may be added to adjust the viscoelasticity of the toners. The viscoelasticity may be adjusted to adjust image gloss and permeation through paper. Examples of inorganic particles include known inorganic particles such as silica particles, titanium oxide particles, alumina particles, cerium oxide particles, and those subjected to hydrophobic treatment. These inorganic particles may be used alone or in combination. To maintain transparency, e.g., to maintain good coloration or the transparency of overhead projector (OHP) sheets, silica particles having a lower refractive index than the binder resin may be used. The silica particles may be surface-treated with various materials such as silane coupling agents, titanium coupling agents, and silicone oil.

Organic particles are generally used to improve cleaning and transfer properties. Examples of organic particles include fluoropolymer powders such as polyvinylidene fluoride and polytetrafluoroethylene powders; fatty acid metal salts such as zinc stearate and calcium stearate; and other materials such as polystyrene and polymethyl methacrylate.

Viscoelasticity

The toners have a loss tangent tan δ of 1.10 to 1.40 or about 1.10 to about 1.40 at 80° C. to 140° C. as determined by viscoelasticity measurement at a frequency of 1 Hz over a temperature range of 30° C. to 180° C.

During the fixing of a toner according to this exemplary embodiment to a recording medium such as a sheet of paper, strain is applied to the toner under the pressure of the fixing device together with heat. The fixing behavior of the toner can be represented by its viscoelasticity, which is largely affected by the viscoelasticity of the binder resin and the amounts and sizes of components such as the colorant, release agent, and other additives dispersed in the resin.

During the process of fixing a toner image to a recording medium, a recording medium on which a toner image is formed is heated, for example, while being held between fixing members, and the binder resin in the toner melts. During this process, for example, if the recording medium has an image-forming surface with projections and depressions, the toner particles on the projections experience a higher pressure from the fixing members than those in the depressions. The toner particles on the projections may collapse and form smooth areas, where the gloss is locally higher. This may result in unevenness in gloss.

In this exemplary embodiment, ionically crosslinked domains are dispersed in the binder resin. Whereas the binder resin melts as the toner is heated and pressurized on the recording medium held between the fixing members during the fixing process, the ionically crosslinked domains maintain their shape without melting, meaning that these domains have a longer relaxation time than the binder resin. After fixing, the surface of the toner on the recording medium has irregularities corresponding to the size of the ionically crosslinked domains.

The loss tangent tan δ of viscoelasticity is the ratio (G"/G') of loss modulus G" to storage modulus G'. A material having a higher tan δ tends to have a higher viscosity, whereas a material having a lower tan δ tends to have a higher elasticity. For toners, tan δ is largely affected by the molecular weight distribution and degree of cross-linking of the binder resin and the material dispersion structure of the toner; therefore, it serves as a control factor affecting the gloss of a fixed toner image. In this exemplary embodiment, tan δ may be controlled since the gloss is largely affected by the ionically crosslinked domains of the binder resin in the toners.

In this exemplary embodiment, the degree of ionic cross-linking is controlled depending on tan δ. If tan δ is 1.10 to 1.40 or about 1.10 to about 1.40, the ionically crosslinked domains have a size larger than visible wavelengths. This may result in low gloss since visible light is scattered by the surface of the toner. Even if a recording medium having a surface with projections and depressions is used, irregularities may remain in the surface of the toner on the projections on the recording medium. This may reduce a local increase in gloss and may thus reduce unevenness in gloss over the entire fixed image. If tan δ falls below 1.10, the ionically crosslinked domains have an even larger size, which results in poor coloration of a fixed color image. If tan δ exceeds 1.40, the ionically crosslinked domains have a small size or are present in small amounts in the binder resin, which tends to result in a higher gloss and unevenness in gloss.

In this exemplary embodiment, tan δ is adjusted to the above range by controlling the distribution and content of a metal element, such as aluminum, that forms the ionically crosslinked domains.

Specifically, the amount of aluminum detected by a photoelectron spectrometer during the argon etching of the toner substrate particles used in this exemplary embodiment for 10 seconds may be 2.0 atomic percent or less. This may result in a tan δ within the above range. The aluminum detected by a photoelectron spectrometer during argon etching for 10 seconds is derived from the ionically crosslinked domains near the surface of the toner. If the amount of aluminum detected exceeds 2.0 atomic percent, the ionically cross-linked domains have a large size or are present in large amounts. This may result in a fixed image with extremely low gloss or may result in poor low-temperature fixing properties since a larger amount of heat is required for fixing.

In this exemplary embodiment, the use of the toners described above may reduce an increase in the gloss of a fixed image and may thus reduce unevenness in gloss even if a fixing member having a thin elastic layer (e.g., 1 mm or less) or no elastic layer is used to achieve a higher image fixing rate.

Specifically, if a fixing member including a substrate, an elastic layer, and a surface layer is used, the elastic layer, which is made of a material that resists the flow of heat, such as rubber, may be made thinner so that the temperature of the fixing unit does not decrease at high image fixing rates (process speeds). However, if a fixing member including an elastic layer having a thickness of 0 to 1 mm (i.e., a fixing member including no elastic layer or a thin elastic layer) is used, the fixing member has a harder surface and thus applies a higher pressure to the toner than those including a thick elastic layer. If the fixing member is used for toners containing no ionically crosslinked domains, the toner particles on the projections on a recording medium would collapse under pressure, which would lead to a local increase in gloss. For the toners according to this exemplary embodiment, as described above, the ionically crosslinked domains present in the binder resin maintain their shape without melting during the fixing process. Since the ionically cross-linked domains are resistant to collapse, irregularities may remain in the surface of the toner. This may reduce an increase in gloss and may thus reduce unevenness in gloss. In this way, the use of the toners according to this exemplary embodiment may reduce an increase in the gloss of a fixed image and may thus reduce unevenness in gloss even if a fixing member including an elastic layer having a thickness of 0 to 1 mm is used.

Method for Measuring Viscoelasticity

The viscoelasticity parameter used in this exemplary embodiment, i.e., tan δ, is measured using a rheometer (ARES Rheometer, Rheometric Scientific, Inc.).

The measurement of tan δ is performed as follows. A toner is molded using a tablet press to prepare a sample. The sample is placed between parallel plates having a diameter of 8 mm at 120° C. to 140° C., is cooled to room temperature (25° C.), and is heated at a heating rate of 1° C./min. During the heating, tan δ is measured at a frequency of 1 Hz over the range of 30° C. to 180° C. at intervals of 2° C. The upper limit of strain is set to 20%.

Image-Forming Process Control System

Figure 6:
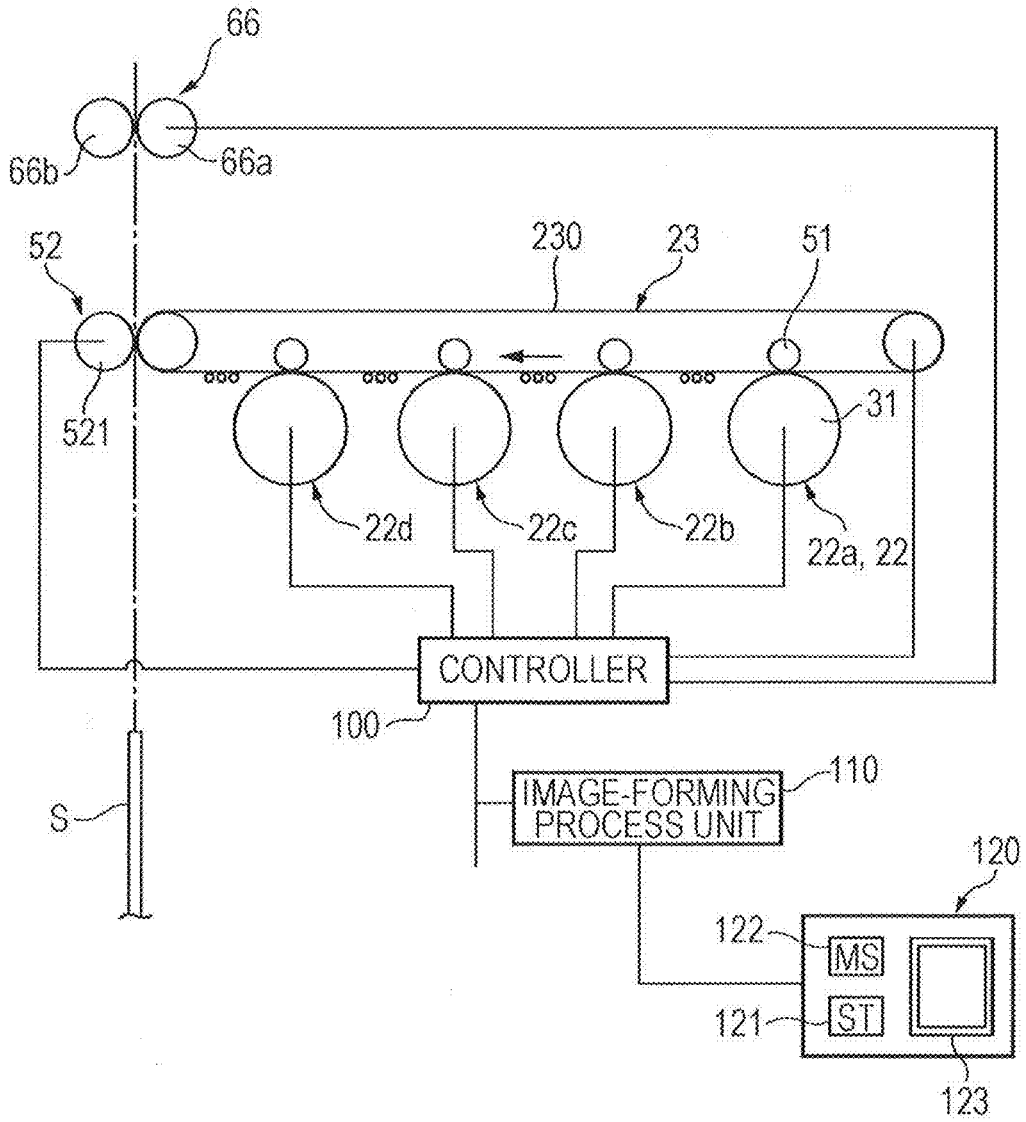
FIG. 6 is a schematic view of an image-forming process control system used in the first exemplary embodiment.

FIG. 6 schematically shows an image-forming process control system used in this exemplary embodiment.

As shown in FIG. 6, a controller 100 is a microcomputer system including a CPU, a RAM, a ROM, and an I/O port. The controller 100 receives signals such as operating signals fed from an operating panel 120 via the I/O port. The CPU executes an image-forming process program (see FIGS. 7 and 8) preinstalled in the ROM in conjunction with the RAM and sends predetermined control signals to the devices such as the image-forming units 22 (i.e., 22*a* to 22*d*), the transfer module 23 (including the intermediate transfer belt 230), the second transfer device 52, and the fixing device 66 via the I/O port.

As shown in FIG. 6, an image-forming process unit 110 is a control function unit that executes the above image-forming process program. In this exemplary embodiment, the operating panel 120 includes a start switch 121 (denoted by ST in FIG. 6) that causes the image-forming apparatus to start an image-forming process, a mode selection switch 122 (denoted by MS in FIG. 6) that issues, for example, a command to form a full-bleed image, and a display 123 that displays the operating status of the image-forming apparatus.

Operation of Image-Forming Apparatus

The operation of the image-forming apparatus will now be described.

For example, when a user prepares a full-bleed image, the user may designate the size of the recording medium on the operating panel 120, select the full-bleed image mode via the mode selection switch 122, and cause the image-forming apparatus to start an image-forming process via the start switch 121.

Figure 7:
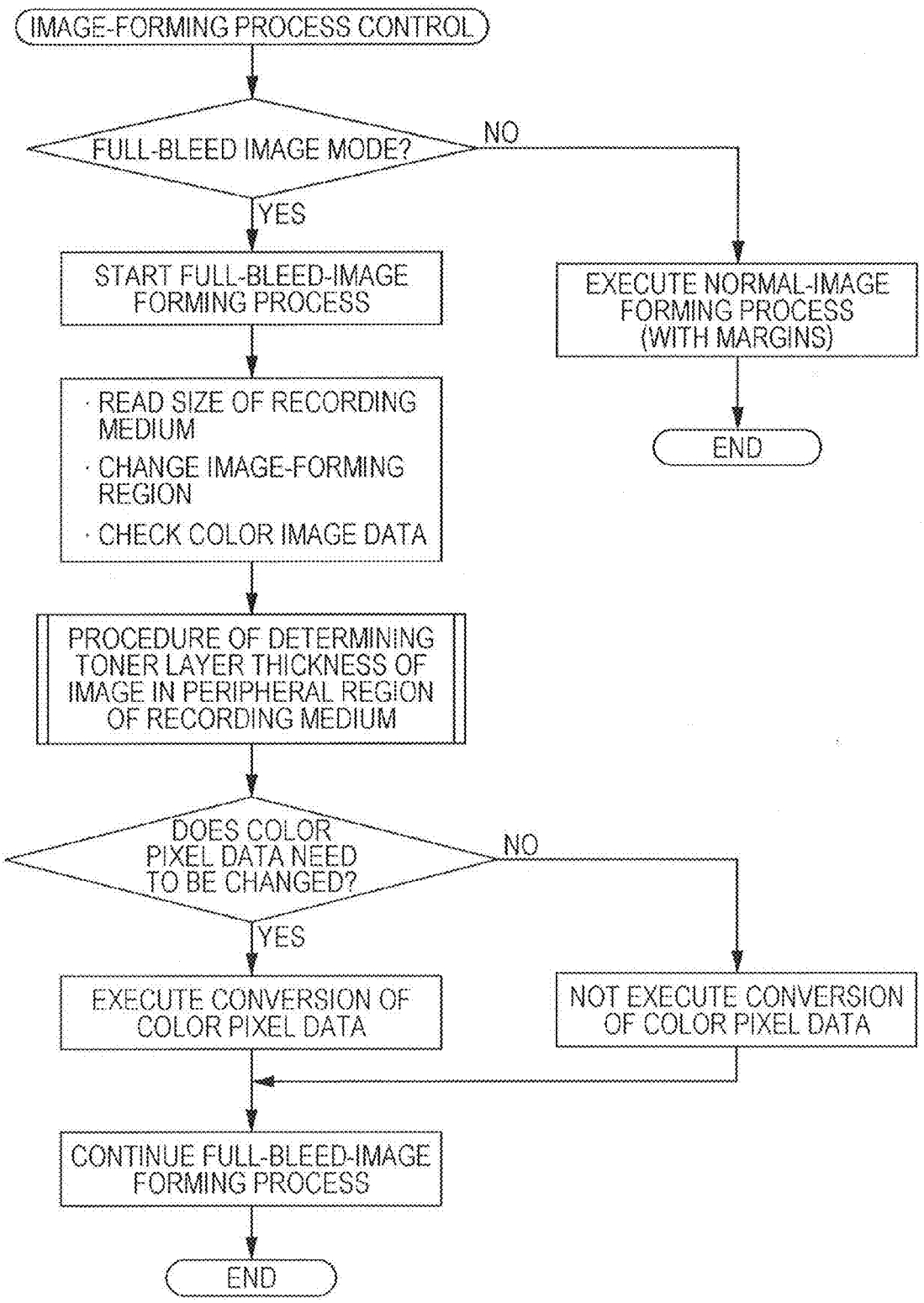
FIG. 7 is a flowchart of an image-forming process control flow used in the first exemplary embodiment.

In this state, as shown in FIG. 7, the image-forming process unit 110 checks whether the full-bleed image mode is selected. If the full-bleed image mode is not selected, the image-forming process unit 110 executes a normal-image forming process. If the full-bleed image mode is selected, the image-forming process unit 110 starts a full-bleed-image forming process.

Figure 9A:
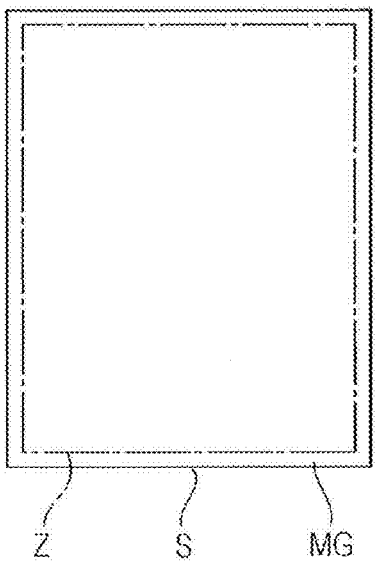
FIG. 9A is a schematic view illustrating a normal-image forming process.

As shown in FIG. 9A, the term "normal-image forming process" as used herein refers to the process of forming an image in an image-forming region Z with margins MG around the recording medium S.

Figure 9B:
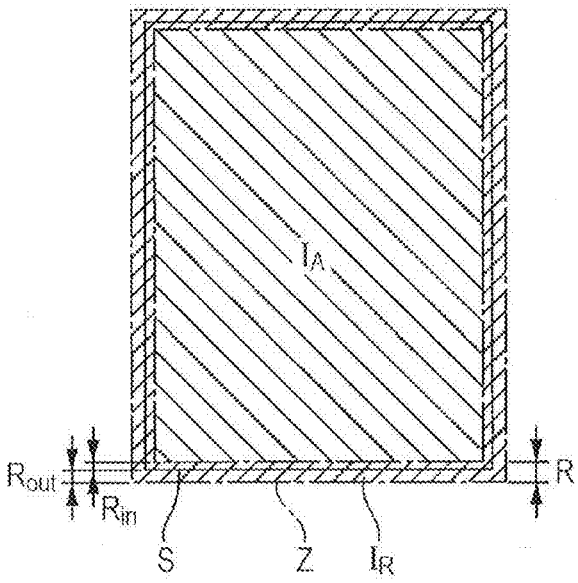
FIG. 9B is a schematic view illustrating a full-bleed-image forming process.

As shown in FIG. 9B, the term "full-bleed-image forming process" as used herein refers to the process of forming a full-bleed image with no margin around the recording medium S in an image-forming region Z larger than the image-forming surface region of the recording medium S.

Upon starting of the full-bleed-image forming process, as shown in FIG. 7, the image-forming process unit 110 executes (1) reading the size of the recording medium, (2) changing the image-forming region, and (3) checking color image data and then executes a procedure of determining the toner layer thickness of the image in the peripheral region R of the recording medium S.

In this exemplary embodiment, as shown in FIG. 9B, the peripheral region R of the recording medium S is selected to include both an inner peripheral region $R_{in}$ having a width of 1 to 3 mm or about 1 to about 3 mm within the recording medium S and an outer peripheral region $R_{out}$ having a width of 2 to 5 mm or about 2 to about 5 mm outside the recording medium S.

Figure 8:
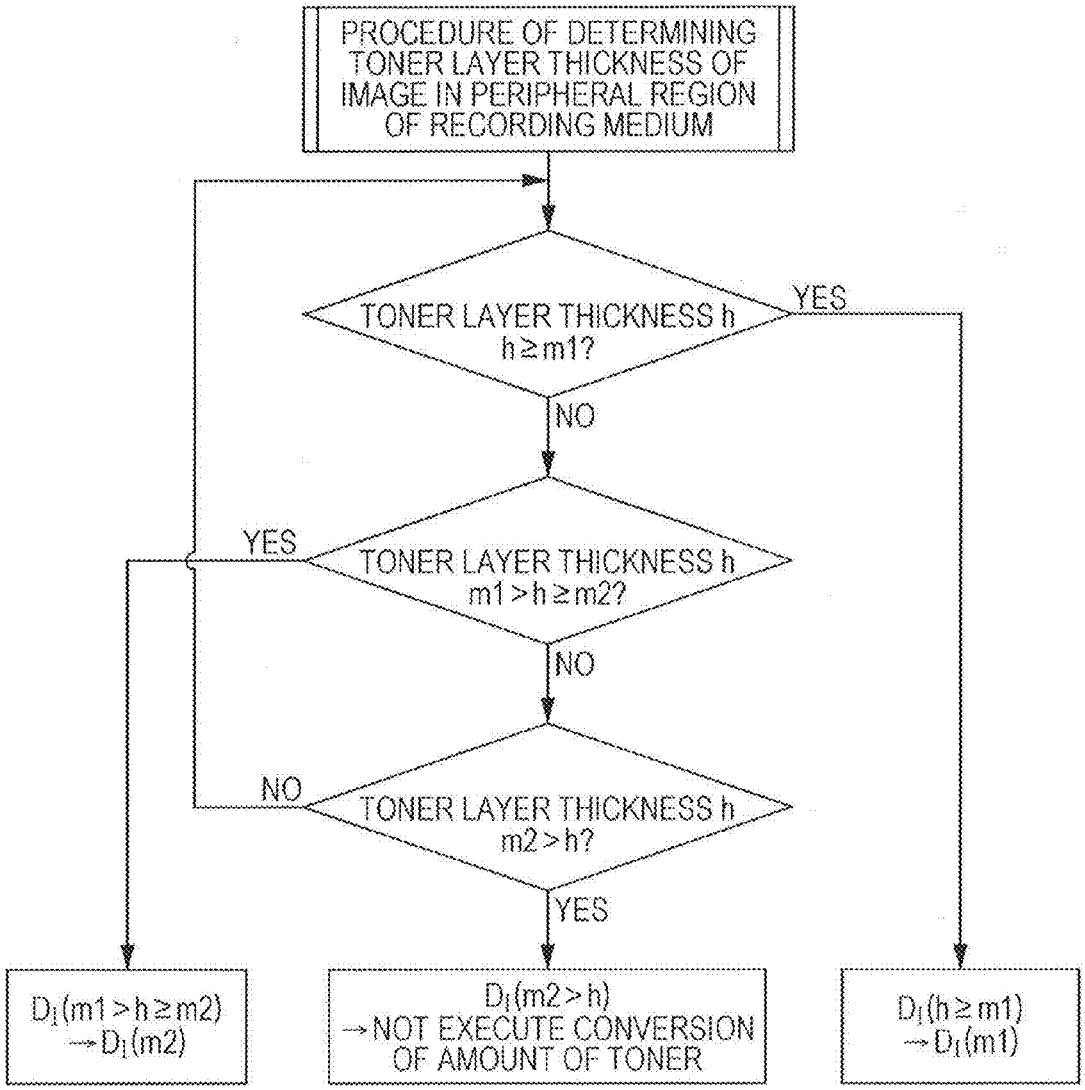
FIG. 8 is a flowchart of a procedure of determining the toner layer thickness of an image in a peripheral region of a recording medium in FIG. 7.

In this exemplary embodiment, the procedure of determining the toner layer thickness proceeds, for example, as shown in FIG. 8.

As shown in FIG. 8, the image-forming process unit 110 checks the color image data for the peripheral region R of the recording medium S. The image-forming process unit 110 then extracts pixels having a toner layer thickness h larger than or equal to a threshold m1 (in this exemplary embodiment, m1=two layers) and determines that the data for all extracted pixels ($D_I(h \geq m1)$) is to be subjected to conversion to the threshold m1 ($D_I(m1)$).

In this exemplary embodiment, the image-forming process unit 110 further extracts pixels having a toner layer thickness h smaller than the threshold m1 but not smaller than a threshold m2 (in this exemplary embodiment, m2=one layer) and determines that the data for all extracted pixels ($D_I(m1 \geq h \leq m2)$ is to be subjected to conversion to the threshold m2 ($D_I(m2)$).

In this exemplary embodiment, the image-forming process unit 110 further extracts pixels having a toner layer thickness h smaller than the threshold m2 (in this exemplary embodiment, m2=one layer) and determines that the data for all extracted pixels ($D_I(m2>h)$) is not to be subjected to the conversion of the amount of toner, i.e., a reduction in the amount of toner.

For example, the toner layer thickness determination procedure proceeds as follows. If each of the Y image data, the M image data, and the C image data has a density of 100%, the toner layer thickness h is 300%. Such pixels are extracted as pixels having a toner layer thickness h of three layers, and it is determined that they need to be subjected to conversion. If each of the Y image data, the M image data, and the C image data has a halftone density, i.e., 50%, the toner layer thickness h is 150%. Such pixels are extracted as pixels having a toner layer thickness of 1.5 layers, and it is determined that they are to be subjected to conversion.

After the determination procedure, as shown in FIG. 7, the image-forming process unit 110 checks whether the color pixel data needs to be changed. The image-forming process unit 110 executes conversion of pixels that need to be changed and does not execute conversion of pixels that need not be changed (in this exemplary embodiment, pixels having a toner layer thickness h smaller than the threshold m2 or equal to zero).

The image-forming process unit 110 executes conversion to the threshold m1 (two layers) or to the threshold m2 (one layer) while maintaining the image density ratio of the individual color images to reduce a change in the hue of each pixel.

Subsequently, the full-bleed-image forming process continues. The image-forming units 22 (22*a* to 22*d*) form images based on the converted pixel data for the peripheral region R of the recording medium. These images are transferred to the intermediate transfer belt 230 and are then transferred to the recording medium S by the second transfer device 52. After the images are fixed by the fixing device 66, the recording medium is output to the recording medium output device 67.

Figure 10A:
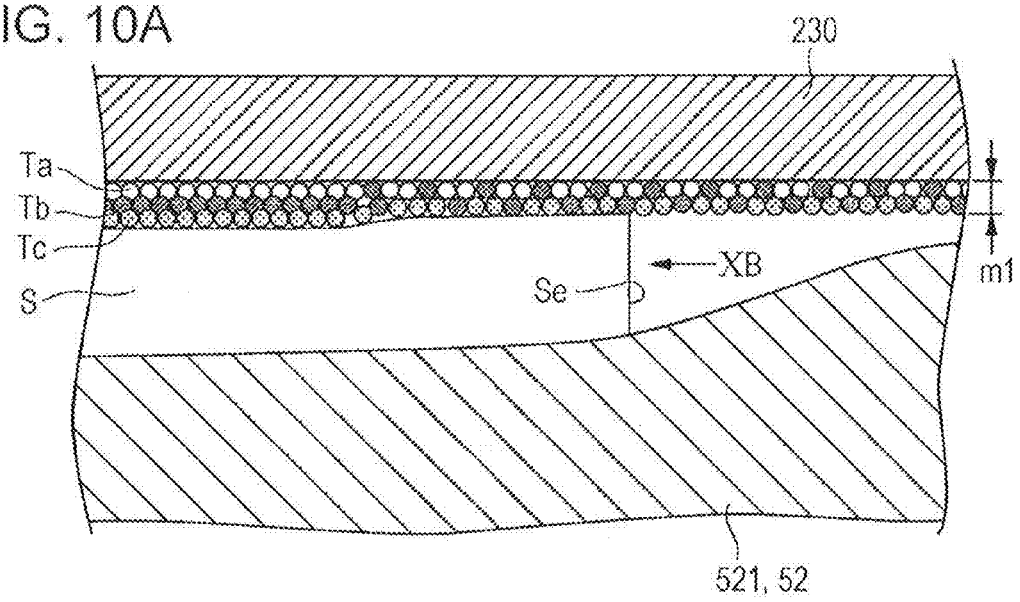
FIG. 10A is a schematic view illustrating a first example process of forming an image in a peripheral region of a recording medium during the full-bleed-image forming process.

FIG. 10A schematically shows the passage of an image through the second transfer unit of the second transfer device 52 after the conversion of the toner layer thickness h in the peripheral region R of the recording medium S to the threshold m1 (m1=two layers).

In this case, two layers of the toners T (Ta, Tb, and Tc), which correspond to the threshold m1, are disposed in the peripheral region R of the recording medium S. The toners T have a small volume average particle size and are deposited in two layers. Since less toner T is present in the peripheral region R of the recording medium S, little toner T may be squeezed out of the edge Se of the recording medium S as the recording medium S is pressed at high pressure by the second transfer unit.

Figure 10B:
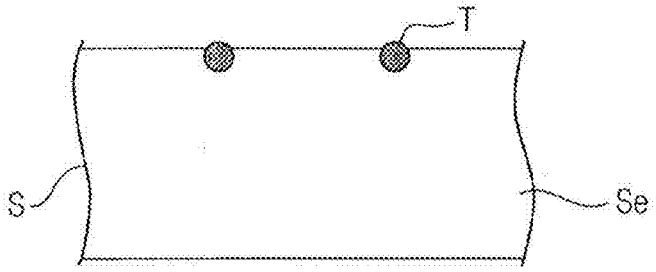
FIG. 10B is a schematic view as viewed in the direction indicated by arrow XB in FIG. 10A.

As shown in FIG. 10B, only a slight amount of toner T may be deposited at the edge Se of the recording medium S near the intermediate transfer belt 230. Although the deposited toner T is not pressurized as the recording medium S passes through the fixing position of the fixing device 66, it may be unlikely to cause toner soiling after printing since the small-sized toners T, which have low-temperature fixing properties, are often melted into a fixed state by heat from the heat fixing roller 66*a*.

Figure 10C:
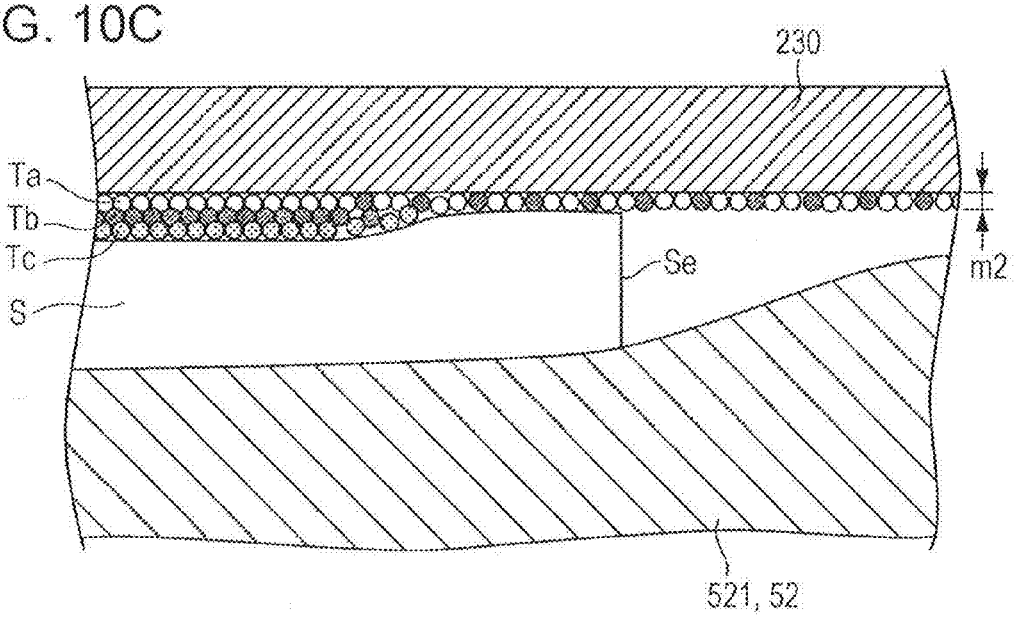
FIG. 10C is a schematic view illustrating a second example process of forming an image in a peripheral region of a recording medium during the full-bleed-image forming process.

FIG. 10C schematically shows the passage of an image through the second transfer unit of the second transfer device 52 after the conversion of the toner layer thickness h in the peripheral region R of the recording medium S to the threshold m2 (m2=one layer).

In this case, one layer of the toners T (Ta, Tb, and Tc), which corresponds to the threshold m2, is disposed in the peripheral region R of the recording medium S. The toners T have a small volume average particle size and are deposited in one layer. Since less toner T is present in the peripheral region R of the recording medium S than toner deposited in two layers, extremely little toner T may be squeezed out of the edge Se of the recording medium S as the recording medium S is pressed at high pressure by the second transfer unit.

As discussed above, in this exemplary embodiment, small-sized toners having low-temperature fixing properties are used, and these toners are deposited to a toner layer thickness h of up to two layers in the peripheral region R of the recording medium S. Little toner T (Ta, Tb, and Tc) may thus be deposited at the edge Se of the recording medium S in the second transfer unit.

Since little toner T may be deposited at the edge Se of the recording medium S during the formation of a full-bleed image, little unfixed toner T may remain at the edge Se of the recording medium S after the recording medium S passes through the fixing device 66.

Figure 11A:
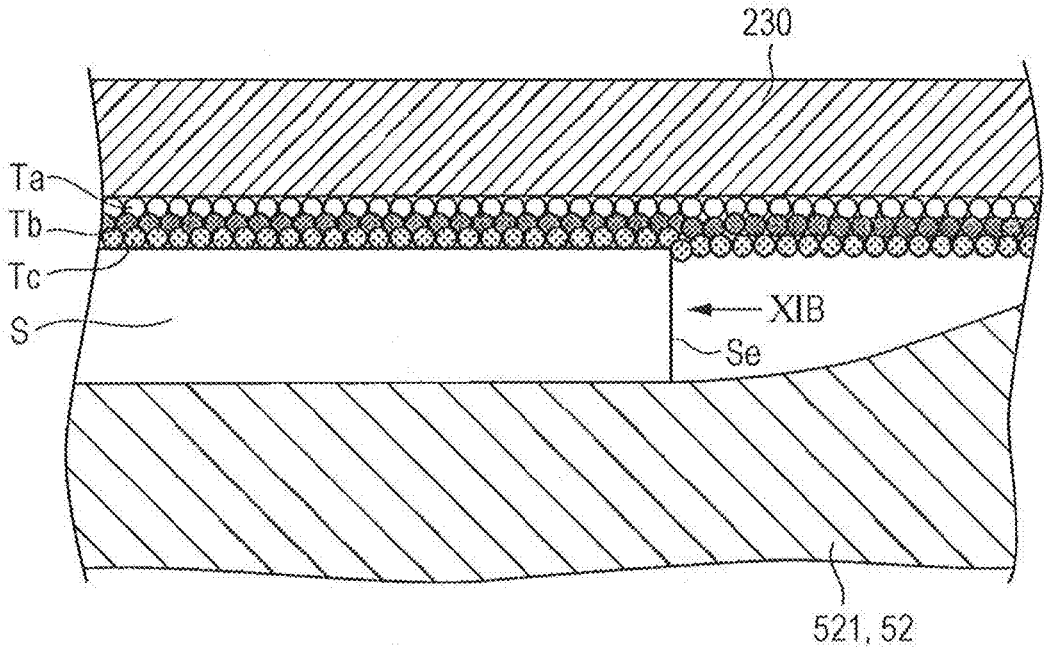
FIG. 11A is a schematic view illustrating the full-bleed-image forming process of an image-forming apparatus according to a reference example (example where the full-bleed-image forming process used in the exemplary embodiment is executed without adjusting the thickness of the image in the peripheral region of the recording medium)
Figure 11B:
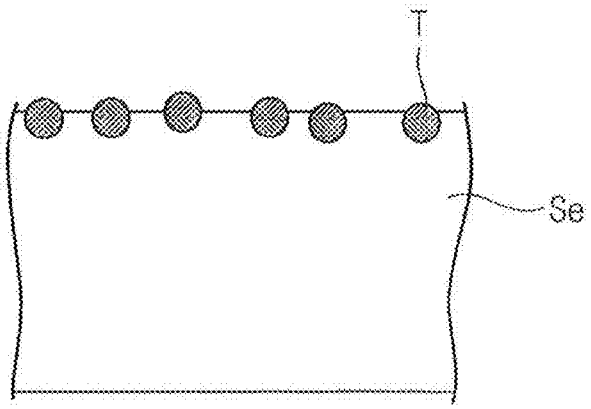
FIG. 11B is a schematic view as viewed in the direction indicated by arrow XIB in FIG. 11A.

As a reference example, FIG. 11A shows the passage of an image having a toner layer thickness h of three layers in the peripheral region R of the recording medium S through the second transfer unit without the adjustment of the toner layer thickness h in this exemplary embodiment. Although the toner layer thickness h is one layer larger than that of the two-layer image in FIGS. 10A and 10B, not much toner T may be squeezed out of the edge Se of the recording medium S in the second transfer unit since the toners T are small-sized toners having low-temperature fixing properties. As shown in FIG. 11B, not much toner T may be deposited at the edge Se of the recording medium S.

Figure 12A:
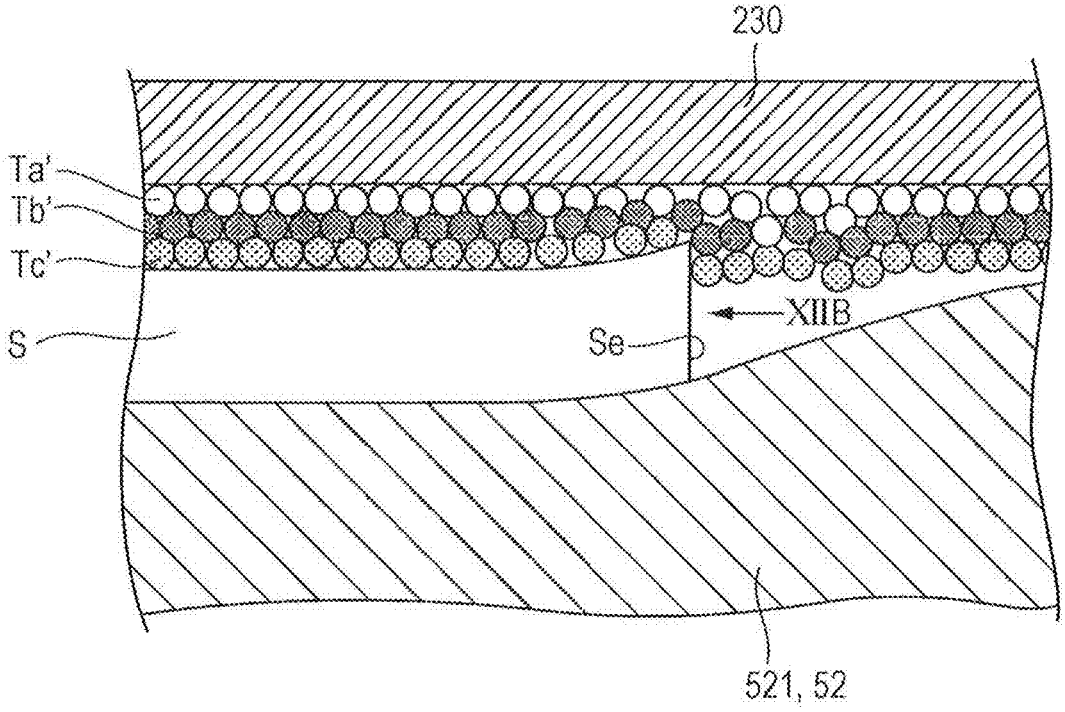
FIG. 12A is a schematic view illustrating the full-bleed-image forming process of the image-forming apparatus according to the first comparative example.
Figure 12B:
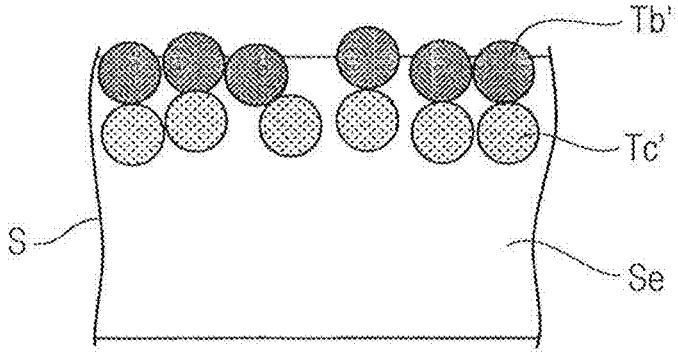
FIG. 12B is a schematic view as viewed in the direction indicated by arrow XIIB in FIG. 12A.

In the first comparative example, a full-bleed image is formed using conventional toners T' (Ta', Tb', and Tc') having a volume average particle size of about 6 to about 7 mm. FIG. 12A shows the passage of an image having a toner layer thickness h of three layers in the peripheral region R of the recording medium S through the second transfer unit without thickness adjustment. Because the toners T' have a large volume average particle size and much toner T' is present in the peripheral region R of the recording medium S since the toners T' are deposited to a toner layer thickness h of three layers, much toner T' is squeezed out of the edge Se of the recording medium S as the recording medium S is pressed at high pressure in the second transfer unit. As shown in FIGS. 12A and 12B, much toner T' is deposited at the edge Se of the recording medium S.

Since the toners T' have a large particle size and much toner T' is deposited at the edge Se of the recording medium S in the first comparative example, not all of the toner T' deposited at the edge Se of the recording medium S is fixed by heat at the fixing position as the recording medium S passes through the fixing device 66. The remaining unfixed toner T' would cause toner soiling after printing.

EXAMPLES

In Example 1, the image-forming apparatus according to the first exemplary embodiment is examined for the relationship between the amount of toner present in the peripheral region of a sheet serving as a recording medium and the amount of toner deposited at the edge of the sheet.

In Comparative Example 1, the image-forming apparatus according to the first comparative example is examined for the relationship between the amount of toner present in the peripheral region of a sheet serving as a recording medium and the amount of toner deposited at the edge of the sheet.

Figure 13A:
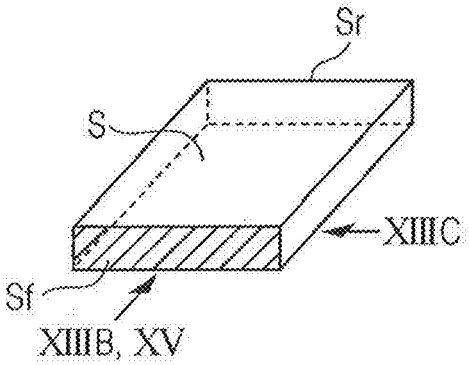
FIG. 13A is a schematic view of a sheet used as a recording medium in the full-bleed-image forming processes of image-forming apparatuses of Example 1 and Comparative Example 1.

In this experiment, full-bleed images extending about 2 mm beyond the edges of sheets are formed using the image-forming apparatuses of Example 1 and Comparative Example 1. The sheets are passed through the second transfer unit, with varying amounts of toner being present in the images formed in the peripheral regions of the sheets. As shown in FIG. 13A, the amount of toner deposited at the front edge Sf of the sheet S is measured. In FIG. 13A, reference character Sr indicates the rear edge of the sheet S.

Figure 13B:
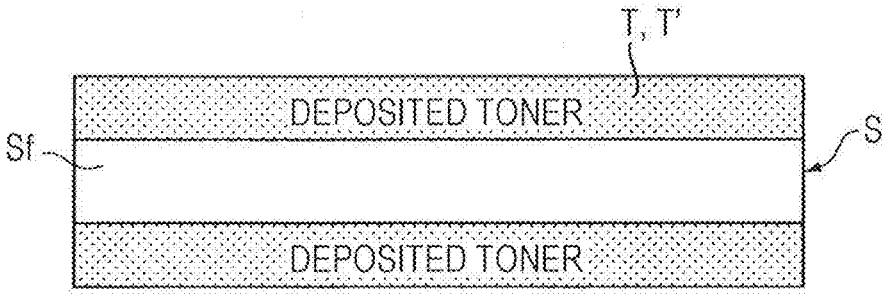
FIG. 13B is a schematic view of a front edge of the sheet in the transport direction as viewed in the direction indicated by arrow XIIIB in FIG. 13A.

As shown in FIG. 13B, toner is found at the front edge Sf of the sheet S near the intermediate transfer belt 230 and the second transfer roller 521.

Figure 13C:
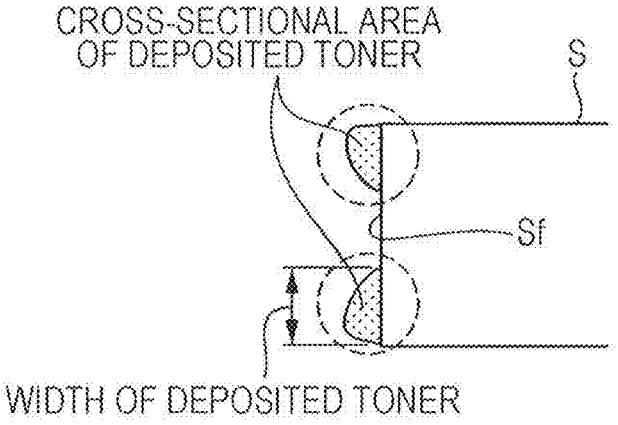
FIG. 13C is a schematic view of the front edge of the recording medium in the transport direction as viewed in the direction indicated by arrow XIIIC in FIG. 13A.

As shown in FIG. 13C, the amount of toner deposited is determined as the cross-sectional area of the toner T (or T') deposited at the front edge Sf of the sheet S as viewed in the direction indicated by arrow XIIIC in FIG. 13A. The measurement is performed using the VK-9500 analysis software (Keyence Corporation).

For the measurement, images are formed at a process speed of 225 mm/sec. The experiment is conducted at room temperature and humidity (23° C., 40% RH) using Ncolor 209 cardboard sheets, which are selected to capture more toner.

The amount of toner deposited at the front edge of a sheet is plotted against the amount of toner deposited in the peripheral region of the sheet. The results are shown in FIG. 14.

The toner weights (g/m$^2$ in n Example 1 and Comparative Example 1 are shown below:

| Toner layer thickness | One layer | Two layers | Three layers |
|---|---|---|---|
| Example 1 | 2.8 | 5.6 | 8.4 |
| Comparative Example 1 | 4.3 | 8.6 | 13.0 |

Figure 14:
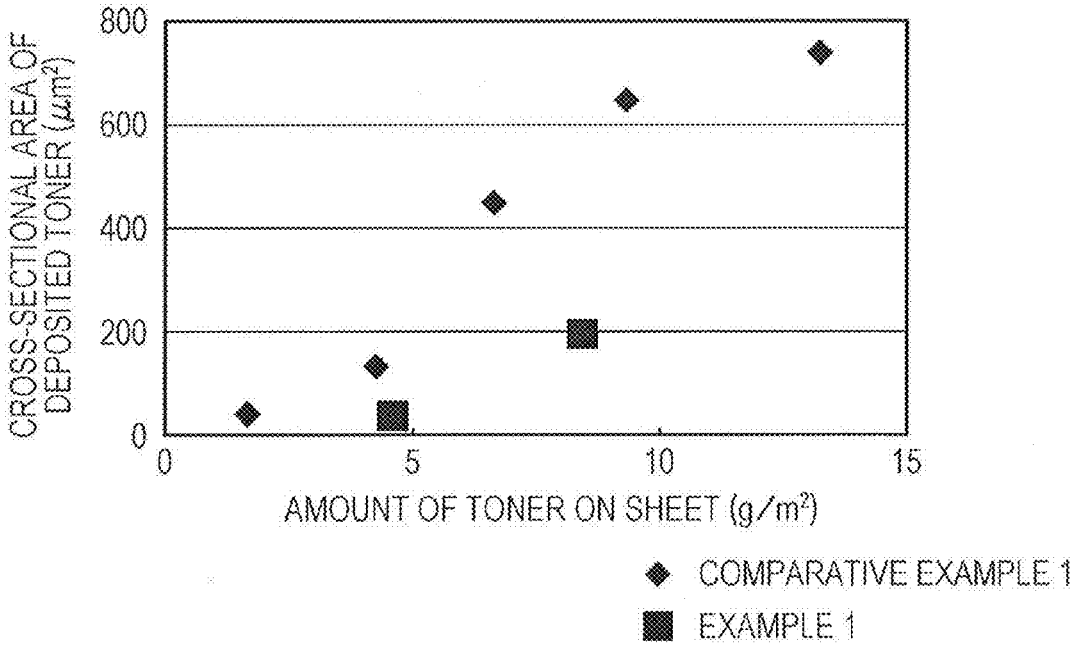
FIG. 14 is a graph showing the relationship between the amount of toner in a peripheral region of a sheet and the cross-sectional area of deposited toner for the image-forming apparatuses of Example 1 and Comparative Example 1.

The results in FIG. 14 show that the cross-sectional area of the deposited toner in Comparative Example 1 is 740 μm$^2$ when three layers of toner (13.0 g/m$^2$) are present in the peripheral region of a sheet, whereas the cross-sectional area of the deposited toner in Example 1 is much smaller, i.e., 200 μm$^2$, when three layers of toner (8.4 g/m$^2$) are present in the peripheral region of a sheet. This demonstrates that less toner is deposited in Example 1.

The results also show that the amount of toner deposited at the edge of a sheet, which depends on the amount of toner in the peripheral region of the sheet, decreases as the amount of toner in the peripheral region of the sheet is reduced by the image-forming process unit.

The results for Example 1 show that the cross-sectional area of the deposited toner is even smaller, i.e., 50 $\mu m^2$ or less, when about two layers of toner (about 5 $g/m^2$) are present in the peripheral region of the sheet.

Figure 15A:
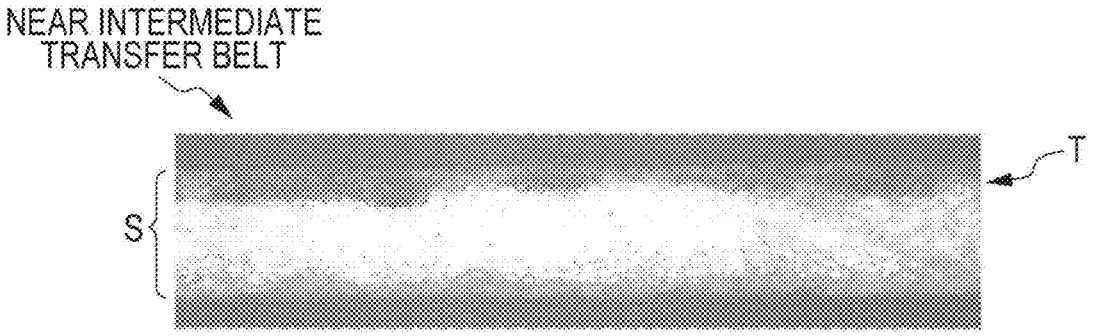
FIG. 15A is a photograph of toner deposited at an edge of a sheet when an image having a toner layer thickness of three layers is formed in the peripheral region of the sheet by the image-forming apparatus of Example 1 using low-temperature fixing toners having a diameter of 4 μm.
Figure 15B:
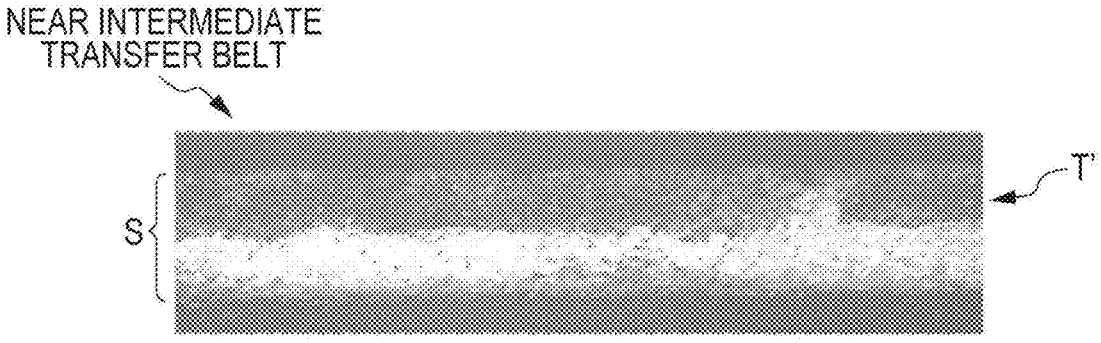
FIG. 15B is a photograph of toner deposited at an edge of a sheet when an image having a toner layer thickness of three layers is formed in the peripheral region of the sheet by the image-forming apparatus of Comparative Example 1 using low-temperature fixing toners having a diameter of 6 μm.

For reference, FIGS. 15A and 15B show photographs, captured in the direction indicated by arrow XIIIB in FIG. 13A, of the toner T (or T') deposited at the front edges of the sheets in Example 1 and Comparative Example 1, respectively, when three layers of toner are present in the peripheral regions of the sheets.

As shown in FIGS. 15A and 15B, in which reference character S indicates the thickness of the sheets, the toner T (or T') are deposited near the intermediate transfer belt, and less toner is deposited in Example 1 than in Comparative Example 1.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image-forming apparatus comprising:

a plurality of image-forming units capable of forming a full-bleed image with no margin around a recording medium in an image-forming region larger than an image-forming surface region of the recording medium using toners of three or more color components having a volume average particle size of about 2 to about 5 μm;

an intermediate transfer member to which images are transferred from the image-forming units and on which the images are carried before the images are transferred to the recording medium;

a transfer device that simultaneously transfers the images from the intermediate transfer member to the recording medium;

a fixing device that fixes the images transferred by the transfer device to the recording medium; and an image-forming process unit that, at least if an image to be formed in a peripheral region of the recording medium during the formation of the full-bleed image has a toner layer thickness larger than or equal to a predetermined threshold, converts the image to be formed in the peripheral region of the recording medium into an image having a toner layer thickness smaller than or equal to the threshold while maintaining the image density ratio of the individual toners.

2. The image-forming apparatus according to claim 1, wherein the toners have a loss tangent tan δ of about 1.10 to about 1.40 at 80° C. to 140° C. as determined by viscoelasticity measurement at a frequency of 1 Hz over a temperature range of 30° C. to 180° C.

3. The image-forming apparatus according to claim 1, wherein the image-forming process unit defines the peripheral region of the recording medium as comprising an inner peripheral region having a width of about 1 to about 3 mm within the recording medium and converts the image to be formed in the peripheral region of the recording medium during the formation of the full-bleed image.

4. The image-forming apparatus according to claim 2, wherein the image-forming process unit defines the peripheral region of the recording medium as comprising an inner peripheral region having a width of about 1 to about 3 mm within the recording medium and converts the image to be formed in the peripheral region of the recording medium during the formation of the full-bleed image.

5. The image-forming apparatus according to claim 1, wherein at least if the image to be formed in the peripheral region of the recording medium during the formation of the full-bleed image has a toner layer thickness larger than or equal to two layers, the image-forming process unit converts the image to be formed in the peripheral region of the recording medium into an image having a toner layer thickness of two layers while maintaining the image density ratio of the individual toners.

6. The image-forming apparatus according to claim 2, wherein at least if the image to be formed in the peripheral region of the recording medium during the formation of the full-bleed image has a toner layer thickness larger than or equal to two layers, the image-forming process unit converts the image to be formed in the peripheral region of the recording medium into an image having a toner layer thickness of two layers while maintaining the image density ratio of the individual toners.

7. The image-forming apparatus according to claim 3, wherein at least if the image to be formed in the peripheral region of the recording medium during the formation of the full-bleed image has a toner layer thickness larger than or equal to two layers, the image-forming process unit converts the image to be formed in the peripheral region of the recording medium into an image having a toner layer thickness of two layers while maintaining the image density ratio of the individual toners.

8. The image-forming apparatus according to claim 4, wherein at least if the image to be formed in the peripheral region of the recording medium during the formation of the full-bleed image has a toner layer thickness larger than or equal to two layers, the image-forming process unit converts the image to be formed in the peripheral region of the recording medium into an image having a toner layer thickness of two layers while maintaining the image density ratio of the individual toners.

9. The image-forming apparatus according to claim 5, wherein if the image to be formed in the peripheral region of the recording medium has a toner layer thickness smaller than two layers but not smaller than one layer, the image-forming process unit converts the image to be formed in the peripheral region of the recording medium into an image having a toner layer thickness of one layer while maintaining the image density ratio of the individual toners.

10. The image-forming apparatus according to claim 6, wherein if the image to be formed in the peripheral region of the recording medium has a toner layer thickness smaller than two layers but not smaller than one layer, the image-forming process unit converts the image to be formed in the peripheral region of the recording medium into an image having a toner layer thickness of one layer while maintaining the image density ratio of the individual toners.

11. The image-forming apparatus according to claim 7, wherein if the image to be formed in the peripheral region of the recording medium has a toner layer thickness smaller than two layers but not smaller than one layer, the image-forming process unit converts the image to be formed in the peripheral region of the recording medium into an image having a toner layer thickness of one layer while maintaining the image density ratio of the individual toners.

12. The image-forming apparatus according to claim 8, wherein if the image to be formed in the peripheral region of the recording medium has a toner layer thickness smaller than two layers but not smaller than one layer, the image-forming process unit converts the image to be formed in the peripheral region of the recording medium into an image having a toner layer thickness of one layer while maintaining the image density ratio of the individual toners.

13. The image-forming apparatus according to claim 5, wherein if the image to be formed in the peripheral region of the recording medium has a toner layer thickness smaller than one layer, the image-forming process unit does not convert the image to be formed in the peripheral region of the recording medium.

14. The image-forming apparatus according to claim 6, wherein if the image to be formed in the peripheral region of the recording medium has a toner layer thickness smaller than one layer, the image-forming process unit does not convert the image to be formed in the peripheral region of the recording medium.

15. The image-forming apparatus according to claim 7, wherein if the image to be formed in the peripheral region of the recording medium has a toner layer thickness smaller than one layer, the image-forming process unit does not convert the image to be formed in the peripheral region of the recording medium.

16. The image-forming apparatus according to claim 8, wherein if the image to be formed in the peripheral region of the recording medium has a toner layer thickness smaller than one layer, the image-forming process unit does not convert the image to be formed in the peripheral region of the recording medium.

17. The image-forming apparatus according to claim 9, wherein if the image to be formed in the peripheral region of the recording medium has a toner layer thickness smaller than one layer, the image-forming process unit does not convert the image to be formed in the peripheral region of the recording medium.

18. The image-forming apparatus according to claim 10, wherein if the image to be formed in the peripheral region of the recording medium has a toner layer thickness smaller than one layer, the image-forming process unit does not convert the image to be formed in the peripheral region of the recording medium.

19. The image-forming apparatus according to claim 11, wherein if the image to be formed in the peripheral region of the recording medium has a toner layer thickness smaller than one layer, the image-forming process unit does not convert the image to be formed in the peripheral region of the recording medium.

20. The image-forming apparatus according to claim 12, wherein if the image to be formed in the peripheral region of the recording medium has a toner layer thickness smaller than one layer, the image-forming process unit does not convert the image to be formed in the peripheral region ofthe recording medium.

* * * * *